United States Patent [19]

Fort

[11] Patent Number: 4,583,727

[45] Date of Patent: Apr. 22, 1986

[54] DEVICE FOR PICKING UP, TRANSFERRING AND TURNING A TEXTILE WEB

[75] Inventor: Jacques Fort, Darnieulles, France

[73] Assignee: "Les Applications Industrielles Vosgiennes" en abrégé "S.A.P.I.V.O.G.", Darnieulles, France

[21] Appl. No.: 619,928

[22] Filed: Jun. 12, 1984

[30] Foreign Application Priority Data

Jun. 24, 1983 [FR] France ..... 83 10438

[51] Int. Cl.[4] ..... B65H 3/30

[52] U.S. Cl. ..... 271/19; 271/14; 271/65; 271/186; 414/55; 414/71; 414/120

[58] Field of Search ..... 271/10, 18.3, 19, 24, 271/25, 21, 22, 11, 14, 65, 186; 414/55, 71, 120

[56] References Cited

U.S. PATENT DOCUMENTS 2,183,077 12/1939 Kast ..... 271/11
2,955,717 10/1960 Segur et al. ..... 414/71
3,355,165 11/1967 Southwell et al. ..... 271/65
4,526,363 7/1985 Fort ..... 271/268

FOREIGN PATENT DOCUMENTS 2523560 9/1983 France .
1128349 9/1968 United Kingdom .

*Primary Examiner*—Bruce H. Stoner, Jr.
*Assistant Examiner*—John A. Carroll
*Attorney, Agent, or Firm*—Fisher, Christen & Sabol

[57] ABSTRACT

A device including unpiling apparatus of the gripper type, each gripper including a pick-up beak, the fixed plate of the gripper being rigid with a carriage movable on a horizontal guide, this carriage being coupled to the piston rod of a fixed fluid-operated cylinder and adapted to transfer the sheet or web picked up by the beak from one pick-up station to the treatment station. It further includes apparatus for causing the pick-up beak to grip the web by turns in a first and a second positions, the second gripping position causing the picked-up web to be turned upside down.

6 Claims, 7 Drawing Figures

DEVICE FOR PICKING UP, TRANSFERRING AND TURNING A TEXTILE WEB

BACKGROUND OF THE INVENTION

1. Field of the invention

The present invention relates to an unpiling device or apparatus for picking up separately the webs constituting a textile pile, and for turning upside down some of the webs before feeding them to a treatment machine, for example a sewing machine.

It is known in fact that when several webs of material obtained for example by folding a same roll of material are cut simultaneously, every other element is reversed.

When machines of this type are fed by automatic means, these reversed elements must be turned upside down automatically.

2. The prior art

The GB-A-No. 1 128 349 patent already proposed of solving this problem by providing a head comprising two grippers, each gripper engaging the ends of the element to be transferred on a conveyor.

During the movement of this head one of the grippers releases the element of which the free end falls upon a deflector, the complete element being subsequently turned by the continued translation of the head.

However, this apparatus is objectionable not only on account of its complexity and therefore its cost, but more particulary on account of its lack of precision in spite of the pneumatic righting device incorporated in the apparatus.

SUMMARY OF THE INVENTION

The present invention is directed to provide a turning device which is of relatively simple design and reliable in operation. This device utilizes the gripper described and claimed in the FR-A-No. 2 523 56 0 patent.

Other features and advantages of the invention will appear as the following description proceeds with reference to the attached drawings.

THE DRAWINGS

DESCRIPTION OF THE PREFERRED EMBODIMENT

As disclosed in this FR-A-No. 2 523 56 0 patent, the gripper comprises a vertically fixed portion consisting of the fixed plate PF having fixed thereto on the one hand a fluid-operated cylinder VR1 and on the other hand, through distance-pieces such as ET, a second fixed plate PFS.

The central portion PC of gripper P is mounted to this second fixed plate PFS.

This central portion PC comprises on both sides a resilient extension PE of one of the arms $B_1$ (or $B_2$) crossing each other to constitute the gripping beak BC.

Each arm comprises a key $T_1$ (or $T_2$) for a purpose to be described presently.

The gripper advantageously comprises five component elements, namely: a hardened steel wire constituting sections PC and PE, a second steel wire constituting arm $B_1$ forming a jaw at its free end, a third wire also of steel terminating with a hook and a pair of blocks constituting in addition said keys $T_1$ and $T_2$.

It will be readily understood that if the central portion PC is held against motion and the keys $T_1$ and $T_2$ are depressed, the relative positions of arms $B_1$ and $B_2$ will be altered and the beak BC will be opened and then closed again when releasing the pressure exerted on the keys.

Figure 1:
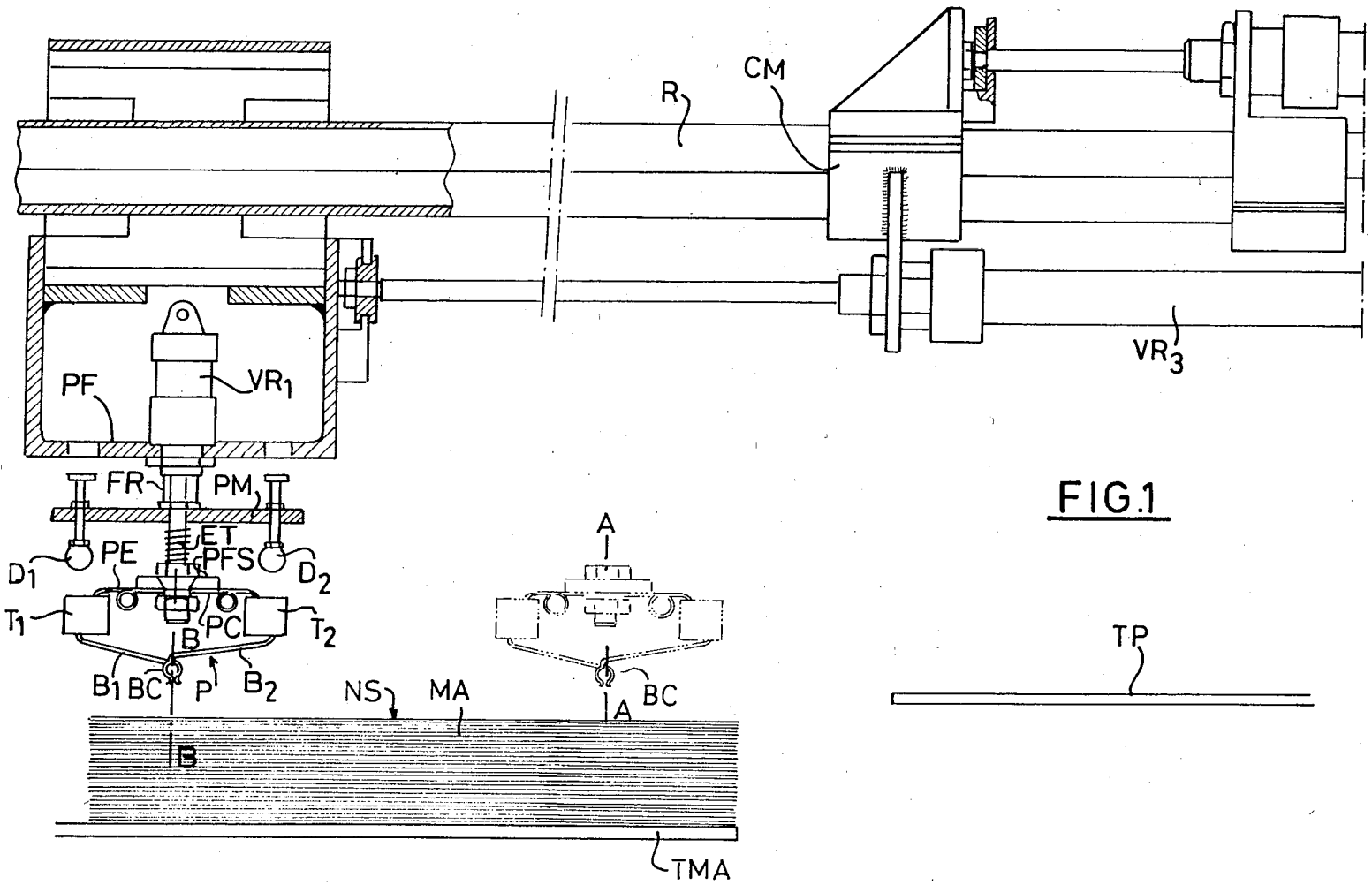
FIG. 1 is a general view of a machine incorporating the unpiling device of FR-A-No. 2 523 56 0 patent modified with a view to turn every other piece of material or web.

Therefore, to open and close the gripper, two ball-headed tappets $D_1$ and $D_2$ carried by a movable plate PM rigid with the piston rod of the fluid operated cylinder VR1 are used. In order to properly position the tappets $D_1$ and $D_2$ with respect to the keys $T_1$ and $T_2$, the movable plate PM is guided by fixed rods (not shown in FIG. 1; shown in the above-described French patent FR-A-No. 2 523 560) slidably engaging sockets FR carried by this plate.

The tappets $D_1$ and $D_2$ are adjustable vertically since their shanks comprise a screw-threaded portion engaging corresponding tapped holes in plate PM.

The above-described gripper is incorporated in an unpiling device forming an integral part in turn of a system for feeding material to a textile machine, for example a sewing-machine.

This arrangement is consistent with the one disclosed in the french patent FR-A-No. 2 523 560 in that the fixed plate PF is mounted to a carriage CM slidably mounted on a rail R and adapted to travel from an unpiling station to a treatment station TP under the control of a fluid-actuated cylinder VR3 of which the piston rod is rigidly connected to said carriage CM.

The unpiling station is completed by a movable table TMA on which the pile MA consisting of stacked sheets or webs possibly cut simultaneously is laid.

This table is rigid with the end of a piston rod of a fluid operated cylinder (not shown) disposed vertically and secured to a frame structure.

This table TMA is rigid with guide rods slidably engaging sockets secured to the frame structure. During each operation this vertical cylinder moves the topmost web of the pile toward beak BC of the gripper so that this gripper can nip and pick up this web as already explained hereinabove.

After causing the web to be picked up by the gripper, this vertical cylinder may cause the table TMA to move downwards while the carriage CM shifted by cylinder VR3 transfers the gripped web from the unpiling station to the treatment station PT designated diagrammatically in the form of another table TP.

When the gripper overlies the table TP, it is opened and drops the previously seized web on the table. Then the carriage is returned to its initial position.

The improved arrangement according to the present invention comprises two unpiling stations A—A and B—B corresponding each to a pick-up position of gripper P located in the vicinity of one of the ends of the stacked webs MA.

If the webs are picked up at station A—A (the position nearest to TP) the web NS is dragged without being turned to the desired position on table TP.

If in contrast thereto the web is picked up at station B—B (the position remotest from TP), the web NS is turned, as clearly shown in FIGS. 2 to 5.

Figure 3:
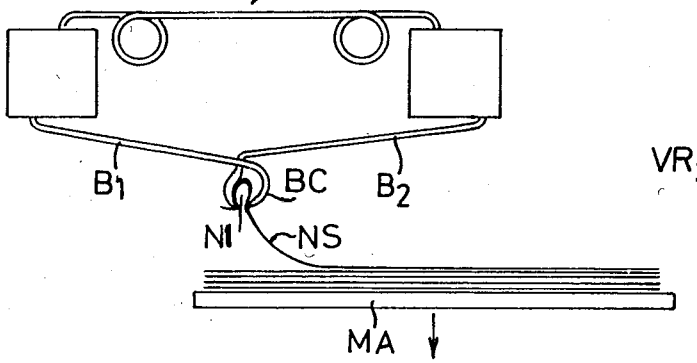
FIGS. 2, 3, 4 and 5 are diagrammatic views showing details of the turning step.
Figure 2:
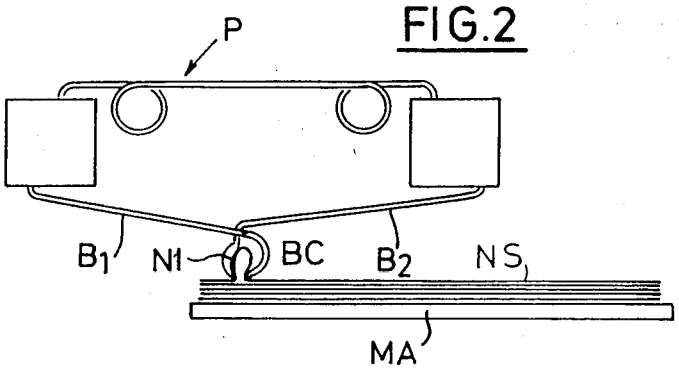
Figure 4:
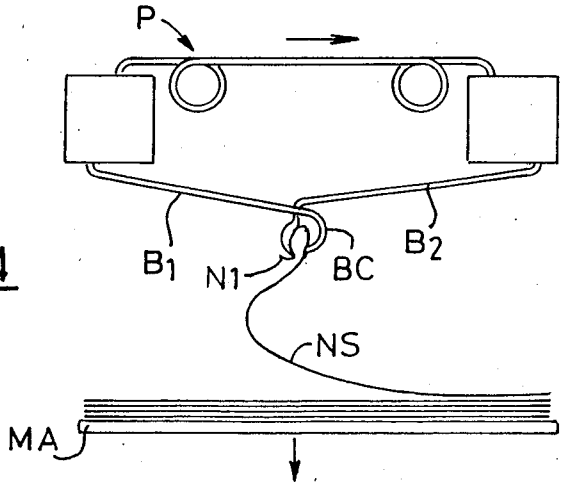

In FIG. 2, the beak BC of gripper P nips only the end $N_i$ of the topmost web NS of pile MA, and lifts this web (FIG. 3). The carriage CM, as a consequence of the contraction of cylinder VR3, continues its movement of translation. Then, the turning of the topmost web NS begins, as clearly shown in FIG. 4.

Figure 5:
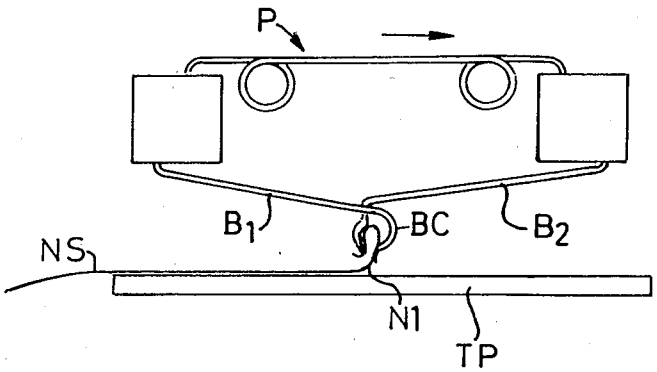

In FIG. 5, this turning movement is completed, the web NS is pulled on table TP as if it had been picked up at A—A.

To permit the picking up of webs either at A—A or at B—B, the unchanging translation arrangement described in the above-mentioned French Patent FR-A-No. 2 523 56 0 is completed by control means capable moving the beak BC to one or the other of said positions A—A and B—B.

Two main solutions are available:

either utilize two cylinders VR3 having different strokes, disposed in parallel and responsive to a cyclical distributor;

or a single, variable-stroke cylinder having its solenoid valves responsive to a logic function of the flip-flop type, or any other equivalent means.

Thus, the gripper P will be positioned by turns at A—A or B—B for performing a cycle consisting of a sequence of pick-ups without turning and pick-ups with turning.

Figure 6:
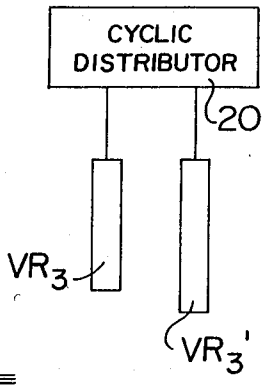
FIGS. 6 and 7 are block diagrams showing controlling devices usable with the apparatus of FIG. 1.
Figure 7:
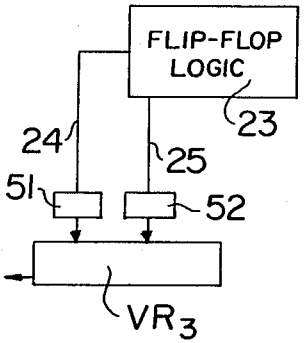

In FIG. 6, a block diagram shows a cyclic districutor 20 for selectively actuating either a first piston VR3, via output lines 21,21, or a longer-strike piston VR3', as discussed above. In FIG. 7, a block diagram shows a flip-flop logic element 23, selectively actuating solenoids 51 or 52 via respective lines 24, or 25, as discussed above.

What is claimed is:

1. A transfer device for feeding sheets to a treatment station of a textile machine, comprising:

an unpiling means provided with a single gripper head, adapted to pick up elements in the form of a textile sheet from the top of a pile of such elements;

said unpiling means being supported for movement in a generally linear path;

a means for actuating said gripper head to pick up a single sheet, a means for moving said unpiling means in a reciprocatory movement along a generally linear path;

said unpiling means having a first station, a second station, and an unloading platform;

actuation of said gripping head at said first station causing gripping of a sheet, such that movement of said unpiling means to said unloading platform causes overturning of the sheet;

actuation of said gripping head at said second station causing gripping of a sheet, such that movement of said unpiling means to said unloading platform does not cause overturning of the sheet; and a means for selectively positioning said piling means at said first station or said second station; whereby said first and said second stations and said means for selectively positioning said unpiling means selectively causes turning or not of the topmost sheet of the pile.

2. A transfer device as claimed in claim 1, further comprising a carriage supporting said gripping means; said carriage being actuated by two fluid-operated cylinders having different piston strokes to move said gripping means selectively to said first station or said second station, and fed in turn through a cyclic distributor.

3. A transfer device as claimed in claim 1, further comprising a carriage supporting said gripping means; said carriage being actuated by a single fluid-operated cylinder controlled as to stroke length by solenoid valves;

said solenoid valves being actuated by a logic function of the flip-flop type;

so as to produce two piston strokes of different lengths.

4. A transfer device for feeding sheets to a treatment station of a textile machine, comprising:

an unpiling means provided with a single gripper head, adapted to pick up elements in the form of a textile sheet from the top of a pile of such elements;

said unpiling means being supported for movement in a generally linear path;

a means for actuating said gripper head to pick up a single sheet;

a means for moving said unpiling means in a reciprocating movement along a generally linear path;

said unpiling means having a first station, a second station, and an unloading platform;

actuation of said gripping head at said first station causing gripping of a sheet, such that movement of said unpiling means to said unloading platform causes overturning of the sheet;

a main support plate;

a finger support member movably connected to said main support plate by means for moving said finger support member;

a pair of fingers connected to said finger support member, each of said fingers being adapted to deflect a key member;

two key members, each respectively mounted by a resiliently deformable member to a key support member;

said key support member being fixedly connected to said main support member and spaced a predetermined distance therefrom;

a pair of gripping members, each respectively connected to a key member;

whereby deflection of said key member by said finger members causes opening of said gripping members;

whereby return of said key members to an undeflected position causes closing of said gripping members to grip a sheet;

actuation of said gripping head at said second station causing gripping of a sheet, such that movement of said unpiling means to said unloading platform does not cause overturning of the sheet and;

a means for selectively positioning said unpiling means at said first station or said second station;

whereby said first and said second stations and said means for selectively positioning said unpiling means selectively cause turning or not of the topmost sheet of the pile.

5. A transfer device as claimed in claim 4, further comprising:

a carriage supporting said gripping means; said carriage being actuated by two fluid-operated cylinders having different piston strokes to move said gripping means selectively to said first station or said second station, and fed in turn through a cyclic distributor.

6. A transfer device as claimed in claim 4, further comprising:

a carriage supporting said gripping means; said carriage being actuated by a single fluid-operated cylinder controlled as to stroke length by solenoid valves;

said solenoid valves being actuated by a logic function of the flip-flop type, so as to produce two piston strokes of different lengths.

* * * * *